United States Patent [19]

Eiselstein et al.

[11] 4,058,416

[45] * Nov. 15, 1977

[54] MATRIX-STIFFENED HEAT AND CORROSION RESISTANT WROUGHT PRODUCTS

[75] Inventors: Herbert Louis Eiselstein; Edward Frederick Clatworthy; Darrell Franklin Smith, Jr., all of Huntington, W. Va.

[73] Assignee: Huntington Alloys, Inc., Huntington, W. Va.

[ * ] Notice: The portion of the term of this patent subsequent to May 31, 1994, has been disclaimed.

[21] Appl. No.: 767,217

[22] Filed: Feb. 9, 1977

Related U.S. Application Data

[62] Division of Ser. No. 654,595, Feb. 2, 1976, Pat. No. 4,026,699.

[51] Int. Cl.[2] ..... C22C 38/48

[52] U.S. Cl. ..... 148/32; 148/38

[58] Field of Search ..... 75/122, 134 F, 128 G, 75/128 T; 148/38, 32

[56] References Cited

U.S. PATENT DOCUMENTS

| | | | |
|---|---|---|---|
| 2,994,605 | 8/1961 | Gill et al. | 75/171 |
| 3,492,117 | 1/1970 | Jackson et al. | 75/128 W |
| 3,516,826 | 6/1970 | Ward et al. | 75/171 |
| 3,592,632 | 7/1971 | Gibson et al. | 75/124 |
| 3,627,516 | 12/1971 | Bellot et al. | 75/128 G |
| 3,758,294 | 11/1973 | Bellot et al. | 75/122 |
| 3,833,358 | 9/1974 | Bellot et al. | 75/122 |
| 3,930,904 | 1/1976 | Eiselstein et al. | 148/38 |

FOREIGN PATENT DOCUMENTS

| | | | |
|---|---|---|---|
| 1,170,455 | 11/1969 | United Kingdom | 75/134 F |
| 1,240,828 | 7/1971 | United Kingdom | 75/134 F |

*Primary Examiner*—Arthur J. Steiner

*Attorney, Agent, or Firm*—George N. Ziegler; Ewan C. MacQueen; Raymond J. Kenny

[57] ABSTRACT

Matrix-stiffened nickel-iron-chromium-columbium solid-solution alloy with excellent metallurgical stability has heat-resistant and corrosion resistant characteristics especially useful for articles needed to sustain stress in long-time service at elevated temperatures, particularly including superheater tubing in steam power plants. Alloy also has good workability and thermal response characteristics for commercial production of heat-treated wrought products.

6 Claims, No Drawings

MATRIX-STIFFENED HEAT AND CORROSION RESISTANT WROUGHT PRODUCTS

This is a division, of application Ser. No. 654,595 filed Feb. 2, 1976 now U.S. Pat. No. 4,026,699.

The present invention relates to heat resistant alloys and more particularly to nickel-iron-chromium alloys.

It is well known that there are many needs for heat resistant alloys for long-time service at elevated temperatures of about 1000° F. to 1500° F., sometimes referred to as the intermediate temperature range. Usually, tensile strength and creep strength, are considered to be some of the more important required characteristics. Additionally, resistance to corrosion by heated atmospheres, frequently including products of fossil-fueled combustion, is required. Furthermore, it is often critically important that the alloy have good metallurgical stability during long time service at elevated temperatures. Thus, there is needed a strong corrosion-resistant alloy having stable strength and ductility characteristics that do not deteriorate during long time exposure at elevated temperatures, e.g., 1000 hours or more, desirably 10,000 hours or 100,000 hours, at 1200° F. or 1500° F.

Also of importance, at least in some instances, are fatigue resistance, impact resistance and resistance to stress-corrosion cracking in chloride containing environments. And, of course, in order to satisfy economic productivity needs the alloy should be readily workable by commercially available manufacturing techniques such as rolling, forging and extrusion in order to produce wrought articles and mill products, e.g., plate, bars and tubing. Furthermore, for fabrication of structures, it is highly desirable that the alloy have good weldability characteristics.

There has now been discovered a good general purpose alloy for long time service at elevated temperatures, particularly including intermediate temperatures in the range of about 1000° F. to 1500° F.

It is an object of the present invention to provide a heat and corrosion resistant alloy.

A further object of the invention is to provide articles and products for long-time service at elevated temperatures, including tubing for main steam lines and super heater tubes in steam power plants.

The present invention contemplates a nickel-iron-chromium-columbium alloy containing, by weight percent, 17% to 22% chromium, nickel in an amount up to 44% and at least sufficient to satisfy the relationship —%Ni equal at least 4/3 (% Cr) + 8.8 —, e.g., at least 31.4% or 31.5% or about 32% nickel, advantageously at least 35% nickel, and more advantageously 38% to 42% nickel, 1.75% to 3.0% columbium, up to about 1% manganese, up to about 1% silicon, up to about 0.1% carbon, up to about 0.5% titanium provided the total of % Ti plus 0.216 (% Cb) does not exceed 0.85%, up to about 0.5% aluminum and balance essentially iron. Usually the alloy contains carbon in a small amount, e.g., 0.05% or 0.06% carbon. Balancing of the alloy composition in accordance with the nickel-chromium and the columbium-titanium relationships herein is especially required for ensuring satisfactory metallurgical stability.

The alloy can also contain, without serious detrimental effect, small amounts of deoxidizers and malleabilizers, such as calcium and magnesium, e.g., about 0.1% or less of each, and may include harmless amounts of other elements, e.g., boron amounts up to about 0.01%.

Molybdenum and tungsten are deemed impurities detrimental to the desired metallurgical stability and, if present, are controlled to avoid exceeding 0.5% molybdenum and 0.5% tungsten. Phosphorus and sulfur also are detrimental impurities and should not be present in amounts greater than 0.015% phosphorus and 0.015% sulfur.

Tantalum, which is often associated in small amounts with commercially purchased columbium, is not a satisfactory substitute for columbium in the present alloy. In a few instances, which were not in accordance with the invention, substitution of an equal proportion by weight of tantalum for columbium resulted in undesirably low creep resistance and rupture life at elevated temperatures, and substitution of tantalum in a greater proportion of one and one-half times the amount of columbium resulted in undesirably low impact strength and poor metallurgical stability. Thus, tantalum is not an equivalent substitute for columbium in the alloy of the invention. Although tantalum may be present as an impurity in minor amounts up to 0.5%, e.g., 0.2%, without serious detriment the total of—%Ti+0.216[%Cb+0.5(%Ta)]—should not exceed about 0.85%.

Annealing treatments for products and articles of the invention are generally at temperatures in the range of 1700° F. to 2200° F. with air or other slow cooling after annealing times sufficient for desired recrystallization, depending on cross-section thickness, e.g., about ½ hour to 2 hours or longer per inch of cross-section thickness. A fine-grain anneal, which can be by heating wrought alloys of the invention at 1750° F. to 1850° F., e.g., about 1800° F., for ½ to 2 hours per inch of thickness to result in an average grain size of ASTM 5 or finer, advantageously ASTM 7 or 6 to 8, is especially beneficial for providing products and articles having an advantageous combination of short-time and long-time strenght and ductility along with corrosion resistance, particularly for service at temperatures from room temperatures to 1200° F. or 1300° F. For long-time service at higher temperatures, e.g., 1400° F. or 1500° F., coarse-grain annealed products of the alloy, with grain sizes ASTM 4 and larger, e.g., 3 and 2, are more advantageous for resisting high temperature creep and rupture. The coarse-grain anneal can be at about 2100° F., possibly 2050° F. to 2150° F.

Especially important useful characteristics of the alloy include metallurgical stability and good strength and ductility when subjected to stress at room and higher temperatures, including elevated temperatures such as about 1000° F., and 1200° F. to 1500° F. In particular, fine-grain annealed wrought products of the alloy are generally characterized at room temperature by a yield strength (0.2% offset) of at least about 35,000 psi (pounds per square inch) and a tensile elongation of at least 30% and at 1200° F. by at least 23,000 psi yield strength and at least 35% elongation. Also of special advantage, the fine-grain products have enduring strength for long-time service at elevated temperatures of about 1000° F. or 1200° F., for instance, 1000-hour stress-rupture strength of at least 31,000 psi with at least 10% ductility at 1200° F. and secondary creep rate not greater than 1% in 1000 hours at 27,000 psi. And, importantly, the alloy provides long-enduring metallurgical stability during exposure at temperatures up to 1400° F. and higher during periods of 1000 and more hours. Moreover, the alloy provides other worthwhile characteristics of corrosion resistance, weldability, fatigue strength and impact resistance and is satisfactory for hot working and cold working by practical production technique.

At 1400° F. the coarse-grain annealed condition of the product provides 1000-hour rupture strength of 10,000 psi or higher and restricts secondary creep to not exceed 1% in 1000 hours at 7500 psi. At room temperature the coarsegrain product has 25,000 psi or more yield strength and 45% elongation.

When carrying the invention into practice it is advantageous to control the composition to consist essentially of 38% to 42% nickel, 18% to 22% chromium, 1.75% to 2.25% columbium, 0.02%-0.07% carbon, 0.1%-0.5% titanium, and balance iron in order to obtain a very good combination of strength, ductility, corrosion resistance and metallurgical stability. Most advantageously, the alloy and wrought articles of the invention have a composition containing about 40% nickel, about 20% chromium, about 2% columbium, about 0.05% carbon, about 0.3% titanium, and balance essentially iron, e.g., about 37.5% iron.

The following examples are given for the purpose of giving those skilled in the art a better understanding and appreciation of the advantages of the invention.

EXAMPLE I

A heat of an alloy of the invention was prepared by induction melting in air a furnace a charge of electrolytic nickel, Armco iron, ferro-chromium, and ferro-columbium in proportions nominally about 40% nickel, 36% iron, 20% chromium and 2% columbium. Additions of 0.4% titanium and 0.4% aluminum were made in the form of titanium scrap and aluminum bar and 0.9% manganese as electrolytic manganese. The melt was cast in a slab ingot mold, cooled, reheated to 2050° F., then hot-rolled to a wide slab, and thereafter 3-inch billets were taken from the slab and hot-rolled to plate, bars and wire rod, including 1-inch thick, 42-inch wide, plate and 1 ½-inch diameter and 9/16-inch diameter bar products. Controlled grain size products were prepared with annealing of the hot-rolled plate and bar at 1800° F. for fine-grain products and at 2100° F. for coarse-grain products. Plate was annealed one hour; bar was annealed about 0.3 hour in a continuous furnace, and then straightened, by medarting. Cooling after annealing was in ambinet air.

EXAMPLE II

Another melt, alloy 2, with proportions for a nickel-chromium-columbium-iron alloy containing about 38.5% nickel, 20% chromium and 2% columbium, was prepared by the air-induction melting practices of Example I and was flux-cast to provide a 20-inch square ingot. After solidification, the ingot was heated and soaked at 2100° F., hot-rolled, and then machined to provide cylindrical shell billets of about 8 ¾-inch outside diameter and 2 ½-inch inside diameter. The machined billets were reheated to 2100° F. and extruded to provide extruded tube products having 3 ¼-inch outside diameter and ½-inch wall thickness. Extrusion reduction ratio was 13.7. A portion of the extruded tubing was cold worked in a conical-die tube-reducing machine, which reduced the tube cross-section dimensions to 2 ⅛-inch outside diameter and 0.275-inch nominal wall thickness. Cold-worked metal of the reduced tube was annealed by heating about 0.3 hour at 1800° F. and air cooling.

Chemical analyses and mechanical properties of alloys and products of Examples I and II are set forth in the following Tables.

The products by virtue of the controlled proportions in the alloy of the invention, have a stable, austenitic, solid-solution microstructure. Recrystallization from the hot-rolled condition, when heated up from room temperature, commences to occur at about 1700° F. Test results in the tables confirm that the products have good retention of strength and ductility for long-time service in stress at elevated temperatures. It is particularly notable that Table IV shows the products had Charpy-V impact properties of about 100 foot-pounds and tensile elongations greater than 20% after stressed exposures of various times and temperatures up to 10,000 and more hours at 1500° F.

TABLE I

| | Chemical Analyses, Weight Percents | | | | | | | | | | |
|---|---|---|---|---|---|---|---|---|---|---|---|
| Alloy No. | Ni (%) | Cr (%) | Cb (%) | C (%) | Ti (%) | Al (%) | Mn (%) | Si (%) | B (%) | Mo (%) | Fe (%) |
| 1 | 40.28 | 20.00 | 1.96 | 0.05 | 0.27 | 0.27 | 0.97 | 0.15 | 0.0005 | NA | Bal. |
| 2 | 38.52 | 19.81 | 1.98 | 0.06 | 0.35 | 0.37 | 0.87 | 0.18 | NA | 0.03 | Bal. |

NA - Not Added and Not Analyzed
Bal. - Balance

TABLE II

| Product | Condition | Test Temp. | YS ksi | UTS ksi | Elong. % | RA % |
|---|---|---|---|---|---|---|
| Alloy 1 | | | | | | |
| Plate | HR | Room | 46.5 | 96.5 | 42 | 60 |
| Bar,9/16" | HR | Room | 55.7 | 102. | 43 | 67 |
| Bar,1 ⅛" | FGA | Room | 62.5 | 98.5 | 38 | 62 |
| Bar,1 ⅛" | FGA | 1000° F. | 45.0 | 81.5 | 35 | 53 |
| Bar,1 ⅛" | FGA | 1100° F | 43.0 | 77.0 | 34 | 55 |
| Bar,1 ⅛" | FGA | 1200° F. | 40.5 | 69.0 | 34 | 60 |
| Bar,1 ⅛" | FGA | 1300° F. | 41.3 | 56.3 | 40 | 76 |
| Plate | CGA | Room | 28.5 | 86.4 | 51 | 61 |
| Plate | CGA | 1000° F. | 16.8 | 68.5 | 51 | 56 |
| Plate | CGA | 1100° F. | 17.0 | 65.7 | 51 | 58 |
| Plate | CGA | 1200° F. | 17.4 | 57.7 | 38 | 40 |
| Plate | CGA | 1300° F. | 17.2 | 52.3 | 36 | 42 |
| Alloy 2 | | | | | | |
| Tube | Ext. +CGA | Room | 31 | 85. | 52. | 68 |
| Tube | TR+FGA | Room | 55.8 | 100.4 | 38 | — |
| Tube | TR+FGA | 1000° F. | 41.0 | 83.7 | 38 | — |
| Tube | TR+FGA | 1100° F. | 39.5 | 76.5 | 42 | — |
| Tube | TR+FGA | 1200° F. | 35.4 | 65.4 | 64 | — |
| Tube | TR+FGA | 1300° F. | 32.9 | 56.2 | 82 | — |

YS - Yield Strength at 0.2% offset
UTS - Ultimate Tensile Strength
ksi - Kips per square inch
Elong. - % elongation-plate and 1 ⅛bar, 2-inch gage length
9/16 bar and Tube Ext., 1.2-inch gage length
Tube TR, on strip specimen-1-inch gage length
RA - Reduction in area
HR - As hot-rolled
CGA - Coarse grain annealed
FGA - Fine grain annealed
Ext. - Extruded
TR - Tube reduced

TABLE III

LONG-TIME TENSILE PROPERTIES

| Product | Condition | Test Temp. | Stress ksi | Hours to 1% Creep | SCR | Hours to Rupture | Elong. % |
|---|---|---|---|---|---|---|---|
| Alloy 1 | | | | | | | |
| Plate | CGA | 1200° F. | 33.5 | — | 0.07 | 5649 | 17 |
| Plate | CGA | 1300° F. | 20.0 | 240 | 0.5 | 3070 | 46 |
| Plate | CGA | 1400° F. | 9.35 | 355 | 1.2 | 1609 | 105 |
| Plate | CGA | 1500° F. | 6.0 | 140 | 3.2 | 1929 | 103 |
| Bar, 1 ⅛" | FGA | 1200° F. | 37.5 | 2 | 2 | 368.8 | 18(2.2"GL) |
| Bar, 1 ⅛" | FGA | 1200° F. | 30.0 | 900 | 1.1 | 3496.2 | 22 |
| Bar, 1 ⅛" | FGA | 1300° F. | 22.5 | 35 | 34 | 351.3 | 61(2.2"GL) |
| Bar, 1 ⅛" | FGA | 1400° F. | 15.0 | 24 | 33 | 102.4 | 92(2.2"GL) |
| Bar, 1 ⅛" | FGA | 1500° F. | 12.0 | — | — | 47.2 | 130(1"GL) |
| Bar, 9/16" | CGA | 1200° F. | 35.0 | — | 0.18 | 4073 | 14 |
| Bar, 9/16" | CGA | 1300° F. | 17.5 | — | 0.18 | 3032 | 40 |
| Bar, 9/16" | CGA | 1300° F. | 14.0 | 3500 | 0.14 | 11,189.7 | 68 |
| Bar, 9/16" | CGA | 1400° F. | 10.0 | 650 | 0.25 | 1526 | 123 |
| Bar, 9/16" | CGA | 1500° F. | 6.0 | — | 1.5 | 2446 | 122 |
| Bar, 9/16" | CGA | 1500° F. | 4.0 | 1900 | 0.28 | 6048NR | — |
| Alloy 2 | | | | | | | |
| Tube, Ext. | CGA | 1200° F. | 37.5 | — | 0.18 | 1363.6 | 14(2.2"GL) |
| " | | 1300° F. | 22.5 | — | 0.24 | 2175NR | 2.9(2.2"GL) |
| " | | 1400° F. | 15.0 | 20 | 9.8 | 383.8 | 54(2.2"GL) |
| " | | 1500° F. | 12.0 | — | 166.0 | 98.2 | 60(2.2"GL) |
| Tube, TR | FGA | 1200° F. | 33.0 | 345 | 3.0 | 1913.9 | 14 ½"GL |
| " | | 1300° F. | 19.0 | 40 | 5.9 | 1612.6 | 50 ½"GL |
| " | | 1400° F. | 8.5 | 58 | 12. | 1444.2 | 104 ½"GL |
| " | | 1500° F. | 10.0 | — | — | 51.2 | 104 ½"GL |

SCR-Secondary creep rate as percent per 1000 hours
Elong. - % elongation, 1.2-inch gage length except where other noted.
NR - Not ruptured

TABLE IV

ROOM TEMPERATURE TENSILE AND CHARPY-V IMPACT PROPERTIES AFTER EXPOSURE AT ELEVATED TEMPERATURES

| Product of Alloy No. 1 | Condition | YS ksi | UTS ksi | Elong. % | RA % | Impact Ft-lb. |
|---|---|---|---|---|---|---|
| Plate (1" thick) | CGA | 28.5 | 86.5 | 51 | 61 | 109–124 |
| " | CGA plus 1000 hours at 1200° F., Air Cool | 30.0 | 87.5 | 50 | 59 | 98 |
| " | CGA plus 1000 hours at 1300° F., Air Cool | 30.0 | 87.5 | 45 | 53.5 | 98 |
| " | CGA plus 1000 hours at 1400° F., Air Cool | 31.5 | 87.5 | 50 | 61 | 96 |
| Bar, 1 ⅛" | FGA plus 5605 hours at 1300° F. and 12,000 psi tensile stress, A.C. | 53.9 | 98.5 | 23(1) | 53 | — |
| Plate | CGA plus 10,415 hours at 1500° F. and 3,500 psi tensile stress, A.C. | 35.5 | 81.4 | 25(1) | 46 | — |
| Bar, 9/16" | CGA plus 6048 hours at 1500° F. and 4,000 psi tensile stress, A.C. | 31.0 | 86.4 | 34 | 62 | — |

Elong. - % Elongation, 1.2-inch gage length except where noted (1) 2.8-inch gage length With the alloy in the coarse grain annealed condition, fatigue tests showed fatigue strength for endurance of $10^8$ cycles of reversed stress in bending (rotating bar) of 33,000 psi at room temperature, 35,000 psi at 1200° F, and 35,000 psi at 1300° F. Fine-grain annealed products of the invention are recommended for obtaining even better fatigue strength.

Additionally, test results demonstrated that the alloy of the invention is resistant to stress-corrosion cracking in magnesium chloride and had good weldability.

The present invention is particularly applicable for the production of boiler plant tubing, including superheater tubes, and other steam plant apparatus. The alloy of the invention is useful for making wrought products, which may be cold worked if desired, such as forgings, rings, bars, rods, plate, sheet and strip and is also for cast articles, such as sand castings, e.g., tube fittings.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. A wrought product consisting essentially of 17% to 22% chromium, nickel in an amount up to 44% and at least sufficient to satisfy the relationship % Ni equal at least 4/3 (% Cr) plus 8.8, 1.75% to 3.0% columbium, up to about 1% manganese, up to about 1% silicon, up to about 0.1% carbon, up to about 0.5% titanium provided the total of % Ti plus 0.216 (% Cb) does not exceed 0.85%, up to about 0.5% aluminum and balance iron with any presence of molybdenum and tungsten not exceeding 0.5% molybdenum and 0.5% tungsten and characterized by a hot-worked austenitic microstructure.

2. A fine-grain annealed wrought product composed of the alloy set forth in claim 1 and characterized by an average grain size of ASTM 5 or finer.

3. A product as set forth in claim 2 having a 1000-hour stress-rupture strength of at least 31,000 psi at 1200° F.

4. A coarse-grain annealed wrought product composed of the alloy set forth in claim and characterized by an average grain size of ASTM 4 or larger.

5. A product as set forth in claim 2 containing 38% to 42% nickel, 18% to 22% chromium, 1.75% to 2.25% columbium, 0.02% to 0.07% carbon and 0.1% to 0.5% titanium.

6. A product as set forth in claim 4 containing 38% to 42% nickel, 18% to 22% chromium, 1.75% to 2.25% columbium, 0.02% to 0.07% carbon and 0.1% to 0.5% titanium.

* * * * *